US005493379A

United States Patent [19]

Kuroda et al.

[11] Patent Number: 5,493,379

[45] Date of Patent: Feb. 20, 1996

[54] HEATER HAVING CONTACTS FOR AC AND DC

[75] Inventors: Akira Kuroda; Nobukazu Adachi; Takeshi Sugita; Akira Yuza, all of Yokohama, Japan

[73] Assignee: Canon Kabushiki Kaisha, Tokyo, Japan

[21] Appl. No.: 159,471

[22] Filed: Nov. 30, 1993

[30] Foreign Application Priority Data

Dec. 2, 1992 [JP] Japan ..... 4-350356

[51] Int. Cl.[6] ..... G03G 15/20; H05B 3/26

[52] U.S. Cl. ..... 355/290; 219/216; 219/449; 219/541; 219/543

[58] Field of Search ..... 219/216, 543, 219/541, 552, 553, 469, 470, 471, 449, 463, 465, 467, 468; 392/438, 439; 355/285, 289, 290

[56] References Cited

U.S. PATENT DOCUMENTS 4,315,141 2/1982 Mills et al. .
4,484,061 11/1984 Zelinka et al. ..... 219/543
4,697,165 9/1987 Ishiguro et al. ..... 219/541
4,798,936 1/1989 Johnson, Sr. .
5,041,809 8/1991 Payne et al. .
5,148,226 9/1992 Setoriyama et al. .
5,149,941 9/1992 Hirabayashi et al. .
5,161,794 11/1992 Adachi .
5,162,635 11/1992 Sato et al. ..... 219/543
5,196,895 3/1993 Setoriyama et al. .
5,210,579 5/1993 Setoriyama et al. .
5,257,078 10/1993 Kuroda .
5,262,834 11/1993 Kusaka et al. .

*Primary Examiner*—Marvin M. Lateef
*Assistant Examiner*—Gregory L. Mills
*Attorney, Agent, or Firm*—Fitzpatrick, Cella, Harper & Scinto

[57] ABSTRACT

A heater with a base member has a resistor extended along a length of the base member and generating heat upon electric power supply thereto. Also provided is a temperature detecting element for detecting the temperature of the base member, and first and second electric power supply contacts for supplying electric power to the resistor, the first contacts being provided only adjacent a first longitudinal end of the base member and the second contacts being provided only adjacent a second longitudinal end of the base member.

12 Claims, 7 Drawing Sheets

HEATER HAVING CONTACTS FOR AC AND DC

FIELD OF THE INVENTION AND RELATED ART

The present invention relates to a heater having a substrate, a resistor and a temperature detecting element thereon.

U.S. Pat. No. 5,149,941, U.S. Ser. No. 444,802, U.S. Ser. No. 712,532 and U.S. Pat. No. 5,148,226 or the like have proposed an image heating apparatus using a quick response thermal heater and a thin film.

Referring first to FIGS. 5 and 6, there is shown an example of a heater usable with such a film type heating apparatus. The heater substrate 3 is made of ceramic material having high thermal conductivity. Am example thereof is an alumina substrate having a thickness of 1 mm, a width of 6 mm and a length of 250 mm. The material thereof may be a compound material containing the same material.

A heat generating layer 5 for generating heat upon electric power supply thereto, is extended on the bottom surface of the heater substrate 3 along the length thereof substantially at the center of the width thereof, and has a width of 1 mm. It is made of electric resistor material such as $TiSiO_2$, Ag/Pd (silver palladium), $RuO_2$, $Ta_2N$, nickel-chrome or the like and such a material is applied to the substrate in the form of a thin film by evaporation, sputtering, CVD, screen printing or the like. At the opposite ends (right and left), there are formed patterns as first and second electroconductive portions 21 and 22 of Au, Ag or the like by evaporation or the like. These patterns function as electric contact for supplying AC power to the heat generating layer 5.

Two AC supply connectors 23 and 24 are mounted at the opposite ends of the heater 6. They are electrically connected with the first and second conductive portions 21 and 22. The heat generating resistor 5 of the heater 6 is supplied with electric power through an AC supply circuit comprising an AC voltage source 25, a TRIAC 26, CPU (central processing unit) 27, a safety device (thermoprotector) 28 such as temperature fuse, and electric wire (AC leads) 29 or the like.

The safety device 28 is connected in the AC power supply circuit in series, and is disposed adjacent to and in contact with the back side of the heater substrate 3. It functions to stop the electric power supply to the heat generating resistor 5 only when the temperature of the heater 6 exceeds a predetermined level.

A thermister 4 functioning as the temperature detecting element is disposed in contact with or adjacent to the backside of the heater substrate 3. The output of the thermister 4 is fed back to the CPU 27 through an electric wiring lead (DC lead). Designated by a reference numeral 30 is a DC voltage source for supplying electric power to the thermister 4. DC connectors 31 and 32 function to electrically connect the thermister 4 and the CPU 27 and the DC voltage source 30. The DC connectors 31 and 32 are disposed adjacent one longitudinal end of the heater. The thermister 4 is disposed at a position which is always a sheet passing region such that the temperature of the sheet passing region is constant irrespective of the size of the recording material.

For the purpose of the temperature control of the heater 6, the electric power supply to the heat generating resistor 5 is controlled such that the thermister 4 detects a constant temperature. For example, the output of the thermister 4 is A/D-converted, and converted signal is supplied to the CPU 27. On the basis of the information, the voltage from the AC voltage source 25 to be supplied to the heat generating resistor 5 through the TRIAC 25 is controlled in the phase or in the number of waves or the like (pulse width modulation), so that the electric power supply to the heater is controlled.

The heater surface having the heat generating resistor 5 may be coated with a surface protection layer 8 (FIG. 5, (*a*)) made of thin heat resistive glass or the like to protect the wearing of the film by the sliding contact. A lubricant may be applied to the heater 6 in sliding contact with the fixing film.

With such an arrangement, there arises a problem that the DC lead 33 is influenced by electric noise by the AC lead 29 with the result of the change of the set temperature for the heater 6. Additionally, the main circuit or the like for controlling the set temperature using the thermister voltage or the like, may operate in erroneous manner.

SUMMARY OF THE INVENTION

Accordingly, it is a principal object of the present invention to provide a heater in which a DC line is not influenced by electric noise.

It is another object of the present invention to provide a heater requiring smaller space in the longitudinal direction, and the assembling is easy.

According to an aspect of the present invention, there is provided a heater comprising: a base member; a resistor extended along a length of the base member, the resistor generating heat upon electric power supply thereto; temperature detecting element for detecting a temperature of the base member; first electric power supply electric contacts for supplying electric power to the resistor, the first contacts being provided only adjacent one longitudinal end of the base member; second electric power supply contacts for supplying electric power to the temperature detecting element, the second contacts being provided only adjacent the other longitudinal end of the base member.

According to an aspect of the present invention, the AC lead 29 and DC lead are away from each other, and therefore, the DC lead is substantially free from the electric noise. Additionally, since the AC connector and the DC connector are away from each other, the longitudinal space may be smaller, and therefore, the size of the apparatus can be reduced. In addition, the assembling operation is easy for the two DC connectors and AC leads.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 2, (*b*) is a bottom plan view of the heater of FIG. 1.

FIG. 2, (*c*) is a circuit diagram of an electric power supply system for the heater shown in FIG. 1.

FIG. 5, (*b*), is a circuit diagram of an electric power supply system therefor.

DESCRIPTION OF THE PREFERRED EMBODIMENTS

Figure 4:
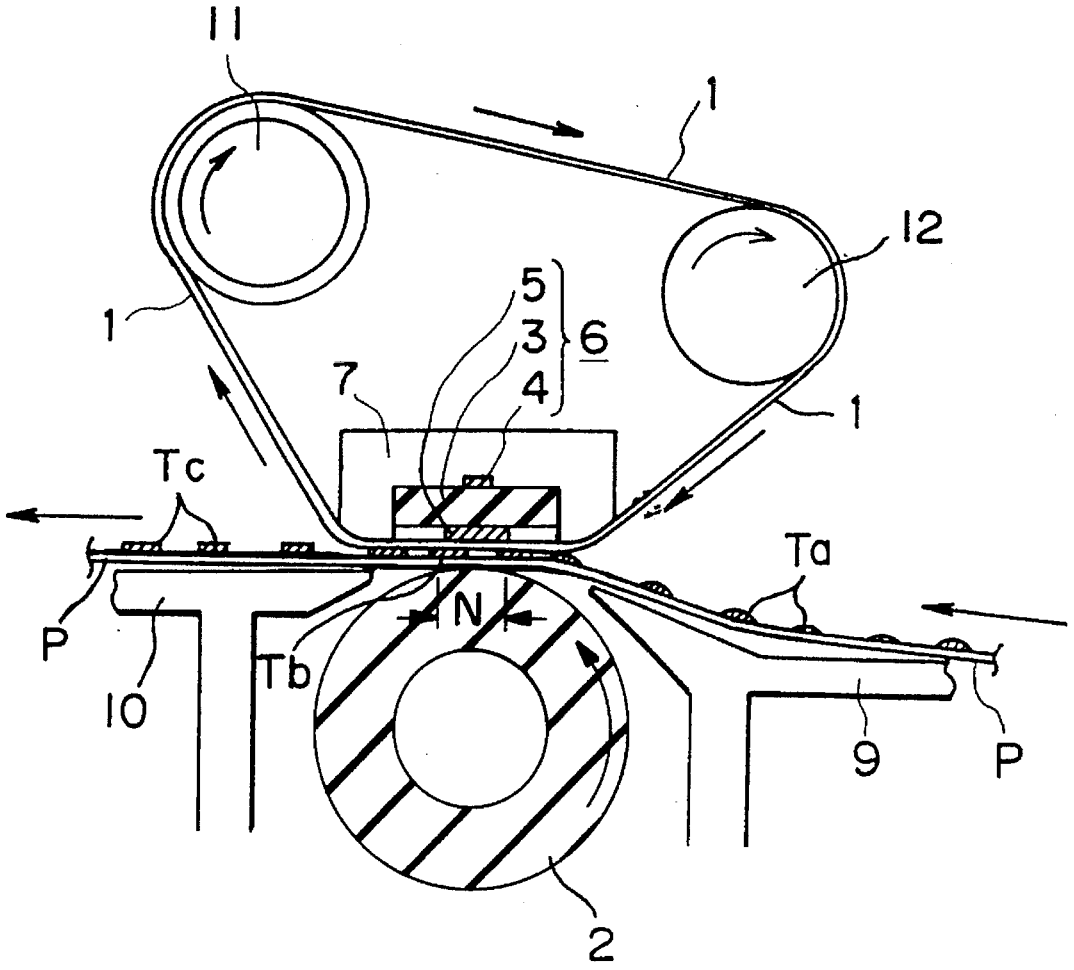
FIG. 4 is a cross-sectional view of a thin film image heating apparatus.

Referring to FIG. 4, there is shown an image heating apparatus using a film according to an embodiment of the present invention. Designated by a reference numeral 1 is a fixing film of heat resistivity in the form of an endless belt. It is extended and stretched around three parallel members 11, 12 and 6, more particularly, a left driving roller 11, a right follower roller 12, and a low thermal capacity linear heater, which will hereinafter be called "heater", fixed at a position below between the rollers 11 and 12.

The follower roller 12 functions also as a tension roller of the endless fixing film 1. The fixing film 1 is driven by the clockwise rotation of the driving roller 11 at a predetermined peripheral speed (which is the same peripheral speed of the recording material P (a material to be heated) having an unfixed toner image TA supplied from an unshown image forming station) without crease, snaking motion or delay.

A pressing roller 2 has a rubber elastic layer made of silicone rubber or the like exhibiting high parting property. It is urged to the bottom surface of the heater 6 by urging means with total pressure of 4–7 kg with a bottom travel portion of the fixing film 1 interposed therebetween. It is rotated in the counterclockwise direction, that is, in the same peripheral movement direction.

The fixing film 1 in the form of an endless belt which is rotated, is repeatedly used for fixing the toner image, and therefore, it is made of highly heat resistive, parting and durable material, having a total thickness of not more than 100 microns, preferably less than 40 microns, more particularly, single layer or multi-layer polyimide film or the like.

The heater 6 comprises, as major components, a heater substrate 3 extending in a direction substantially perpendicular to the film 1 moving direction (sheet feeding direction) which has electrically insulative and high heat resistance nature and has a low thermal capacity, a heat generating resistor 5 in the form of a line or stripe extending along the length of the substrate on a front side of the heater, and a heater temperature detecting element 4 in the form of a thermister contacted to a backside of the substrate 3 (opposite from the side having the heat generating resistor). The thermal capacity of the heater 6, as a whole, is low. The heater 6 is fixed to a heater holder 7 through thermal insulation with the front side thereof exposed.

Upon generation of image formation start signal, an image forming process is carried out in an image forming station not shown, and a recording material P (FIG. 4) supplied to the fixing device is guided by an inlet guide 9, and is introduced into a nip N (fixing nip) between the temperature-controlled heater 6 and the pressing roller 2, more particularly, between the fixing film 1 and the pressing roller 2. It is passed through the fixing nip N between the heater 6 and the pressing roller 2 at the same speed as the feeding speed of the recording material P with the surface of the recording material P having the unfixed toner image being contacted to the bottom surface of the film which is moving in the same direction and at the same speed as the recording material P.

The toner image on the recording material P receives the heat from the heater 6 through the film 1 while the toner image bearing surface of the recording material P is passed through the fixing nip N in pressure-contact to the film surface, so that the toner image is fused on the recording material P has a softened and deposited toner image Tb. The recording material P is separated from the film 1 at a point of time when the recording material P has passed through the fixing nip N.

The recording material P separated from the film 1 is guided by a guide 10 to an unshown pair of discharging rollers. During this period, the high temperature of the toner Tb (higher than the glass transition point) lowers by spontaneous cooling to a level below the glass transition point, so that a solidified toner image Tc is produced. Then, the recording material P having the fixed image is discharged.

Figure 7:
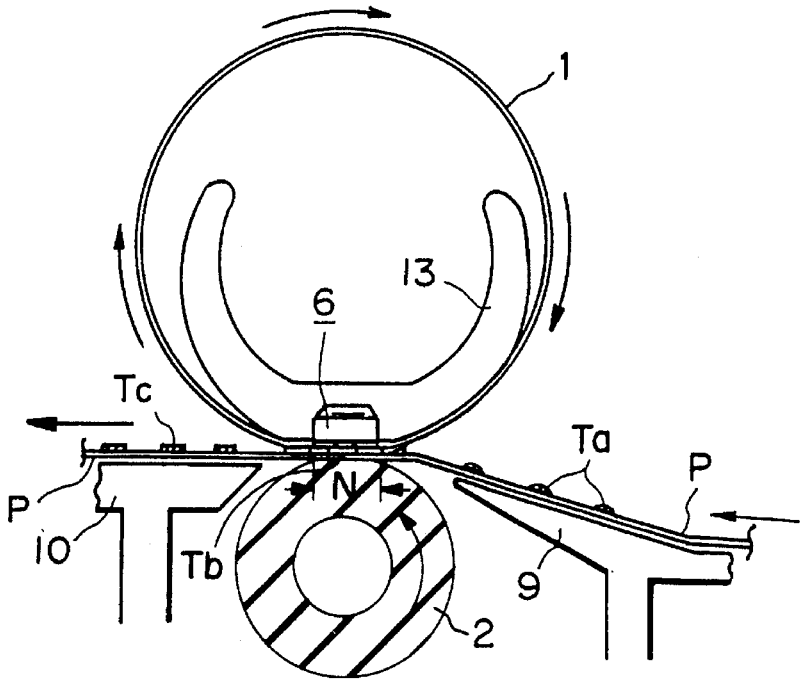
FIG. 7 is a sectional view of a heating apparatus using a film, according to a further embodiment of the present invention.

FIG. 7 is a sectional view of another example of an image heating apparatus. This apparatus is called tensionless type apparatus. Designated by a reference numeral 13 is a guiding member for guiding an inside surface of the film, and has a shape like a trough having a semi-circular arc. The guiding member 13 has a groove for receiving a heater, extending along a length of the guiding member 13 adjacent a center of the outer bottom surface. The heater 6 is fixed in the groove.

A cylindrical fixing film 1 is loosely extended around the guiding member 13 with the heater 6. A pressing roller 6 is press-contacted to the heater 6 with the film 1 therebetween. By the rotation of the pressing roller 2, the cylindrical fixing film 1 is in sliding close contact with the bottom surface of the heater 6, such that it rotates around the outer surface of the guiding member 13.

With the film being thus rotated, the recording material P is introduced between the film 1 and the pressing roller 2, and is passed through the fixing nip N, by which, similarly to the case of FIG. 4 apparatus, the thermal energy from the heater 6 is applied to the recording material P through the film 1, so that the toner image is heat-fixed.

In the case of FIG. 4, a relatively strong tension is applied in the entirety of the fixing film 1. However, in the case of FIG. 7, the tension is applied only at the fixing nip N, and such a portion of the film upstream of the fixing nip N with respect to the movement direction of the film as is in contact with the outer surface of the film guiding member 13, and the tension is not applied in almost all of the other portion of the fixing film.

In the case of such a tensionless type apparatus, the film shifting force (the force for moving the film 1 in the longitudinal direction of the heater 6 during the film driving) is smaller than in the case of FIG. 4. Therefore, the structure of the film shift limiting means or the film shift control means, can be simplified. For example, the film shift limiting means may be in the form of a simple flange member for abutment by an end of the film, thus eliminating the necessity for the reciprocation control mechanism for controlling the lateral shifting of the film.

Figure 8:
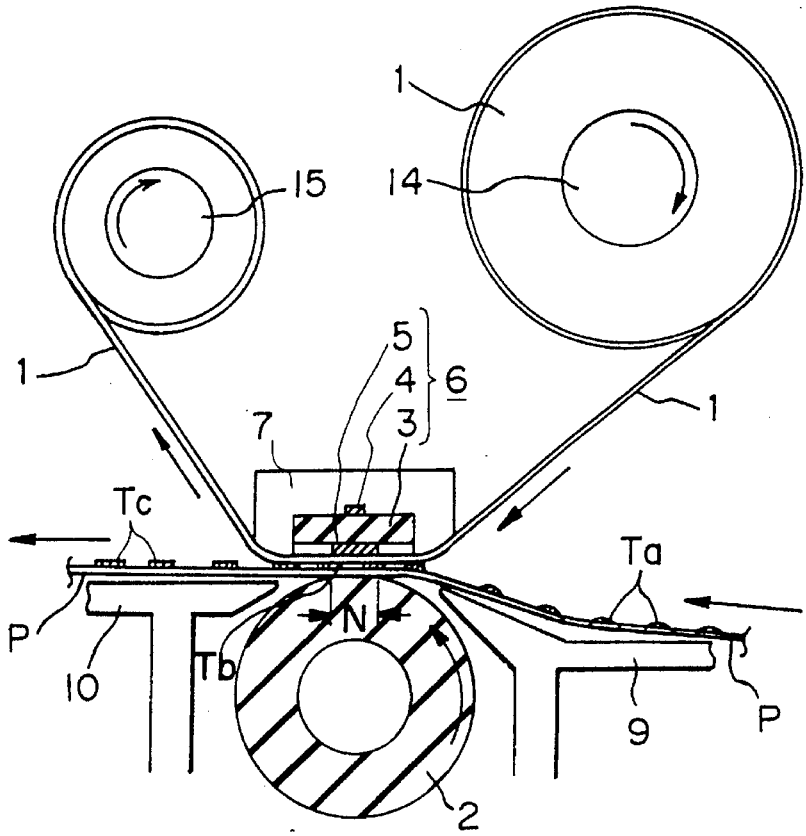
FIG. 8 is a sectional view of a heater using a film, according to a yet further embodiment of the present invention.

FIG. 8 is a sectional view of an image heating apparatus according to another embodiment of the present invention. A non-endless fixing film 1 is wound around a supply shaft 14, and is wound up on a take-up shaft 15 by way of a nip between a heater 6 and a pressing roller 2. The fixing film 1 is fed from the supply shaft 14 to the take-up shaft 15 at the same speed as the sheet feeding speed for the recording material P.

The description will be made as to a heater according to an embodiment of the present invention.

Figure 1:
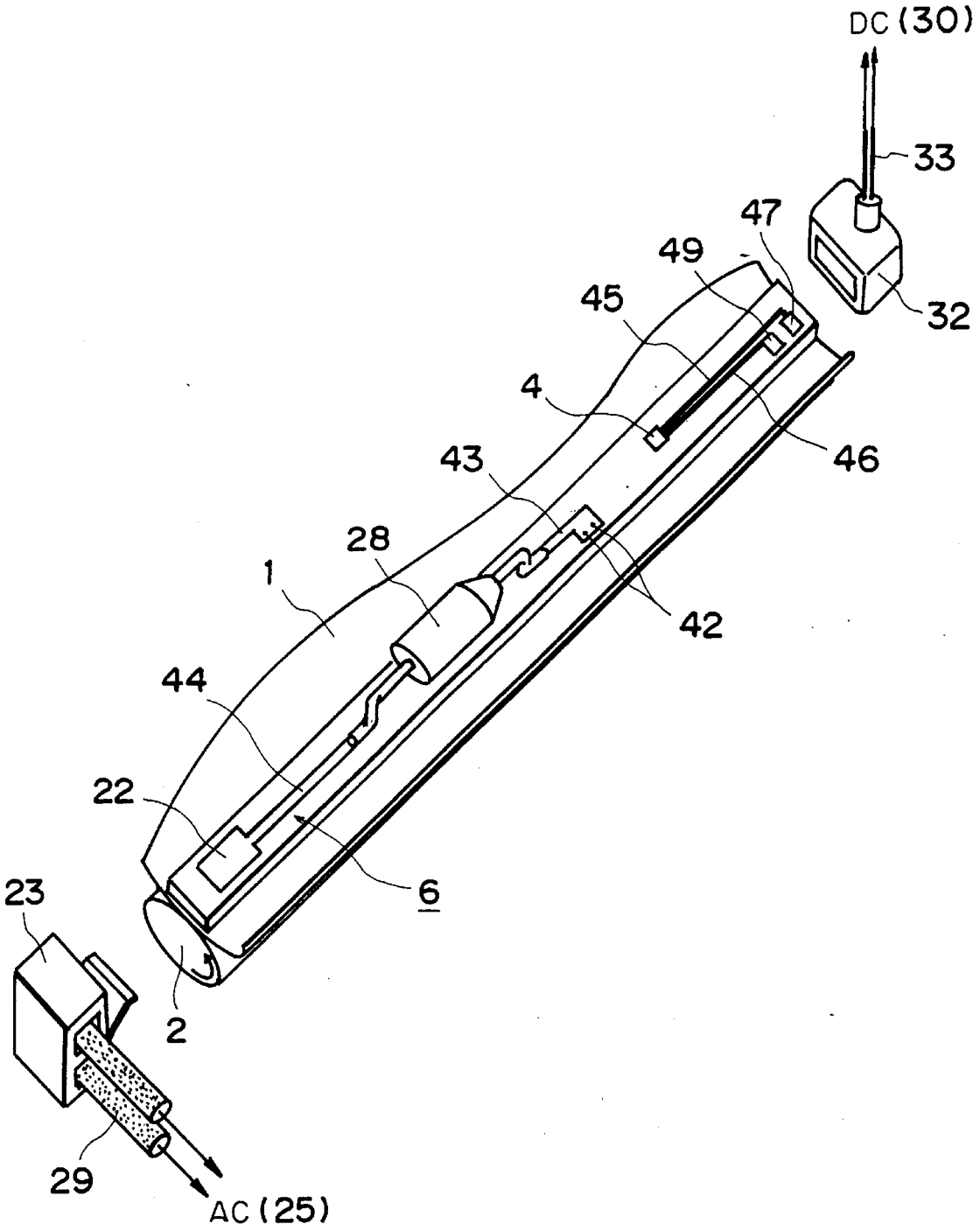
FIG. 1 is a perspective view of a heater according to an embodiment of the present invention.
Figure 2A:
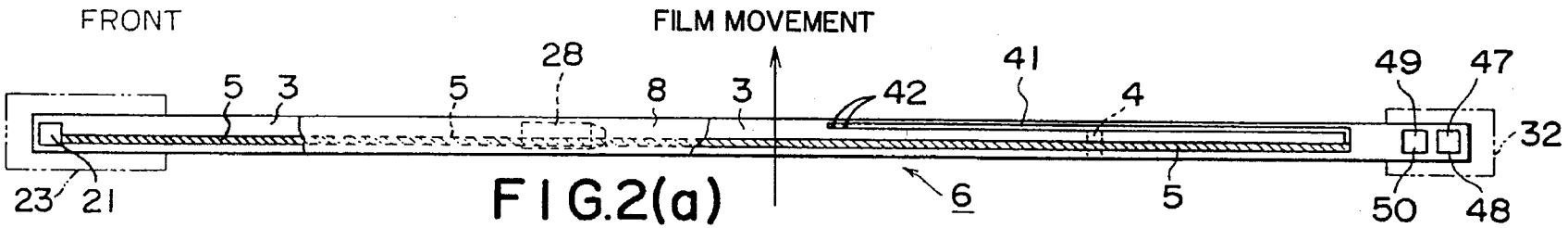
FIG. 2, (*a*) is a top plan view of a heater shown in FIG. 1.
Figure 2B:
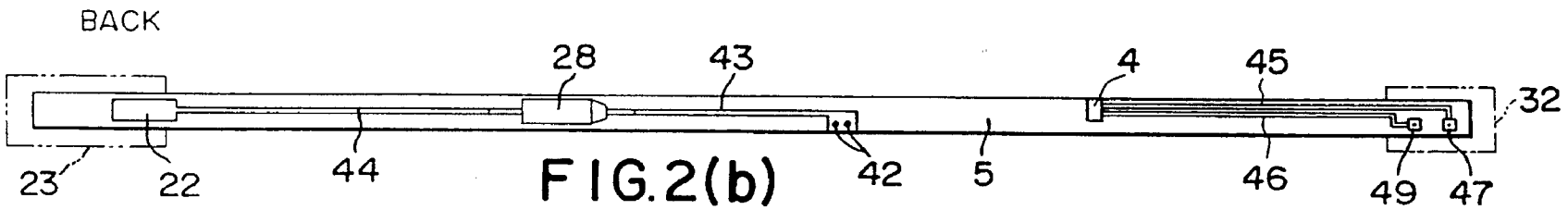
Figure 2C:
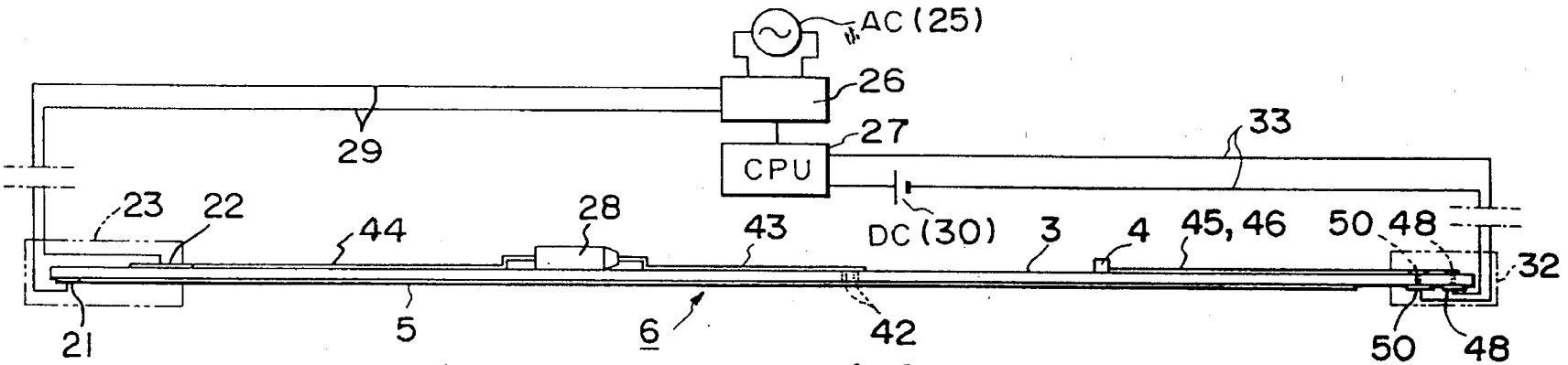

FIG. 1 is a perspective view as seen from the bottom side of the heater 6. FIG. 2, (*a*), is a partly broken top plan view of a front side of the heater 6, and (*b*) is a bottom plan view, and (*c*) shows a circuit diagram of a power supply system for the heater 6.

In a front side of the heater shown in FIG. 2, (*a*), a first AC conductive portion 41 is electrically connected with a right end of the heat generating resistor 5, and is turned back to the substantial longitudinal center of the heater substrate 3 to the left substantially in parallel with the heat generating resistor 5, on the front surface of the heater substrate 3.

Referring to FIG. 1 and FIG. 2, (*b*), a second AC conductive portion 43 and a third AC conductive portion 44 are formed on the left half of the bottom side of the heater substrate 3.

A second conductive portion 22 is formed together at the left end portion of the third AC conductive portion 44, as an electric contact for the AC power supply.

Between the second and third AC conductive portions 43 and 44, contacts of the safety device 28 are electrically connected in series.

A left end portion of the first AC conductive portion 42 on the front side of the heater substrate and the right end portion of the second AC conductive portion 43 on the backside of the heater substrate, are electrically connected through a small diameter through hole 43.

Thus, the conductive portions 21 and 22 as the first and second electric contacts for the AC power supply to the heat generating resistor 5 are located at a front side and a backside of the heater substrate 3 adjacent the left end portion of the heater substrate 3. Therefore, the conductive portions 21 and 22 are electrically connected through (heat generating resistor 5)—(the first AC conductive portion 41)—(through hole 42)—(the second AC conductive portion 43)—(the safety device 28)—(the third AC conductive portion 44).

In FIG. 1, and FIG. 2, (*b*), first and second DC conductive portions 45 and 46, are extended along the length of the substrate in the right half part of the backside of the heater substrate 3. To the left ends of the conductive portions 45 and 46, contacts for the thermister 4 are electrically connected in series. The thermister 4 is disposed at a position of sufficient creepage distance from the AC conductive portions 42–45, 22 on the heater surface and a heat generating resistor 5.

In FIG. 2, (*a*), first and second conductive portions 48, 49 function as electric contacts for DC power supply, which are juxtaposed adjacent the right end of the surface of the heater substrate 3. The two (first and second) conductive portions 45 and 46, and the right end portions of the first and second DC conductive portions 45 and 46 on the backside of the heater substrate, are electrically connected through through holes 47 and 49 having small diameters.

In this manner, the first and second conductive portions 45 and 46 functioning as the electric contacts for the DC power supply adjacent the right end of the surface of the heater substrate 3, are electrically connected with each other through (the through hole 47)—(the first conductive portion 45)—(thermister 4)—(the second conductive portion 46)—(through hole 49).

The conductive portions 21, 22, 41–46, 48 and 50 are pattern-formed on the front and back side of the heater substrate 3 through evaporation or the like using highly electroconductive material.

An AC connector 23 is connected to the longitudinally left end of the heater 6, and a DC connector is mounted to the right end thereof. By the mounting of the AC connector 23 to the left end of the heater, the contacts of the two AC leads 29 of the connector 23, are electrically connected to the conductive portions 21 and 22 functioning as the first and second AC power supply electric contacts on the front and backside of the substrate adjacent the left end of the heater. By doing so, the AC power supply to the heat generating resistor 5 is enabled.

By the mounting of the DC connector 23 to the right end of the heater, the contacts of the two DC leads 33 of the connector 32 are electrically connected to the conductive portions 48 and 50 functioning as the first and second AC power supply electric contacts on the front side of the substrate adjacent the right end of the heater, so that the DC power supply to the thermister 4 is enabled.

Each of the AC and DC conductive portions of the heater 6 is connected with an AC voltage source 25 or a DC voltage source 30 through an AC connector 23 or a DC connector 32 disposed separately at the respective opposite longitudinal ends of the heater 6.

According to the embodiment, the following advantageous effects are provided.

(a) The DC conductive portions 45 and 46 are disposed on the backside of the heater 6, and are disposed with sufficient creepage distance from the AC conductive portions 42–44, 22 and the heat generating resistor 5. In addition, the DC and AC connectors 32 and 23 for connection with the respective DC and AC conductive portions, are disposed separately at the opposite longitudinal ends of the heater 6. Therefore, the electric noise to the DC conductive portion from the AC circuit, and the resultant set temperature change for the heater and malfunction of the main circuit, can be avoided.

(b) The contacts of the safety device 28 and thermister 4 are connected with the conductive portions on the backside of the heater, and therefore, the necessity for the wiring of the AC and DC leads which have been necessary in the prior art, has been eliminated. Therefore, the safety device 28 and the thermister 4 connected with the voltage sources 25 and 30 in the main apparatus through lead wirings 29 and 33, are connected with the heater 6, so that they may be formed into a unit, by which the assembling manipulation is made easier.

Figure 5A:
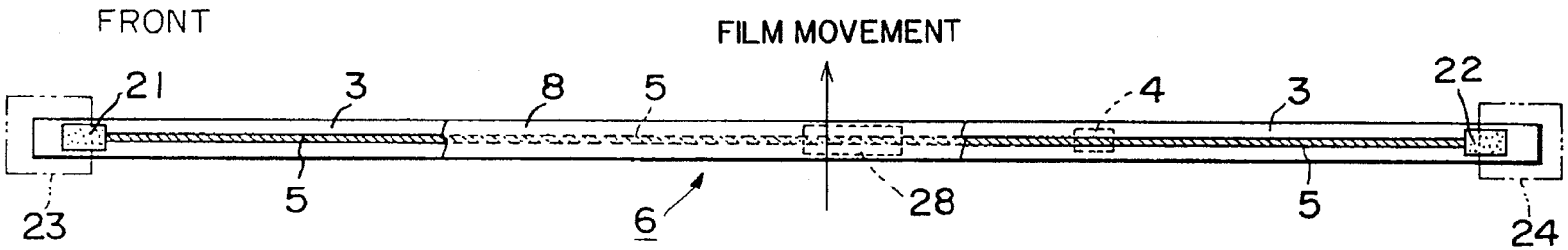
FIG. 5, (*a*), is a partly broken top plan view of a heater.
Figure 5B:
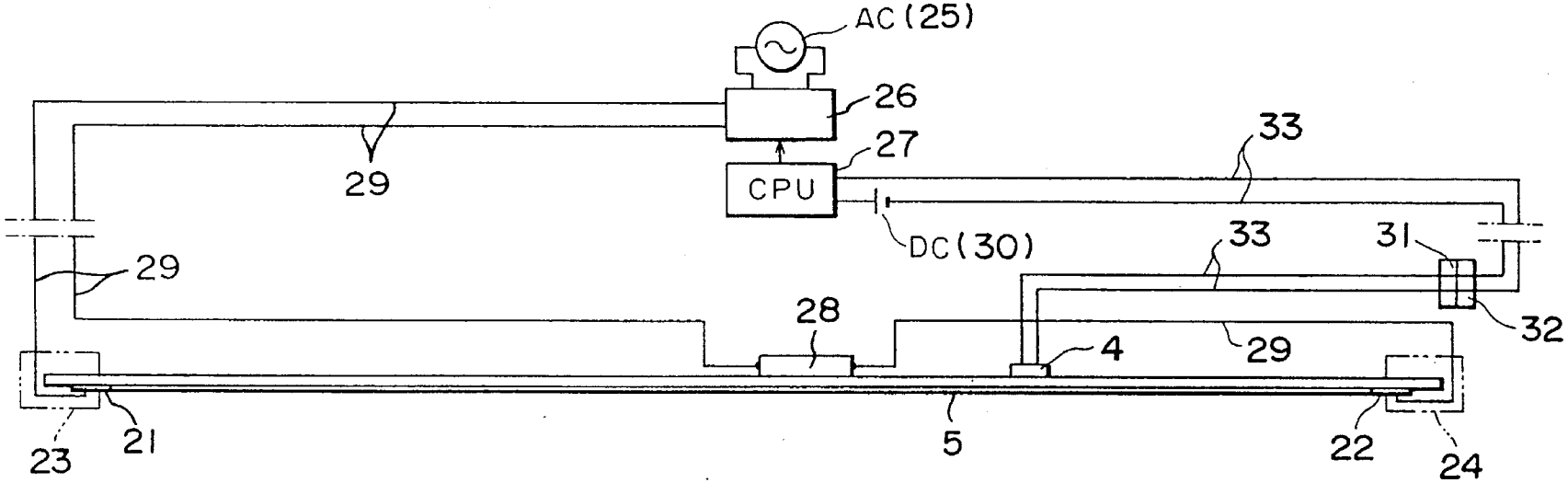
Figure 6:
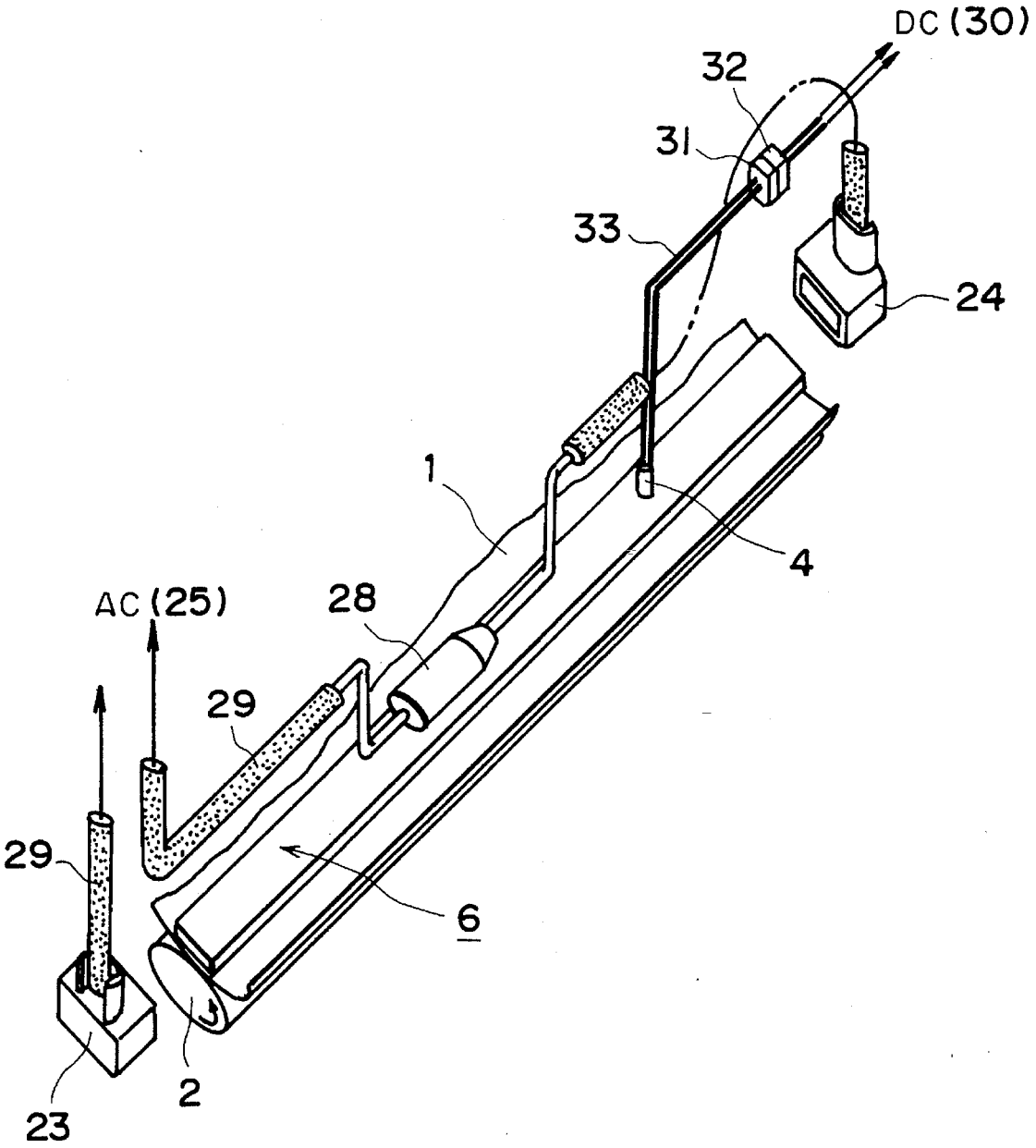
FIG. 6 is a perspective view of a heater portion.

(c) In the prior art, the AC and DC connectors 24, 31 and 32 (FIGS. 5 and 6) occupy the space at one longitudinal end of the heater 6. However, according to the embodiment, the AC and DC connectors 23 and 32, can be disposed separately into two parts, thus saving the required space. This further leads to the reduction of the size of the apparatus.

Figure 3:
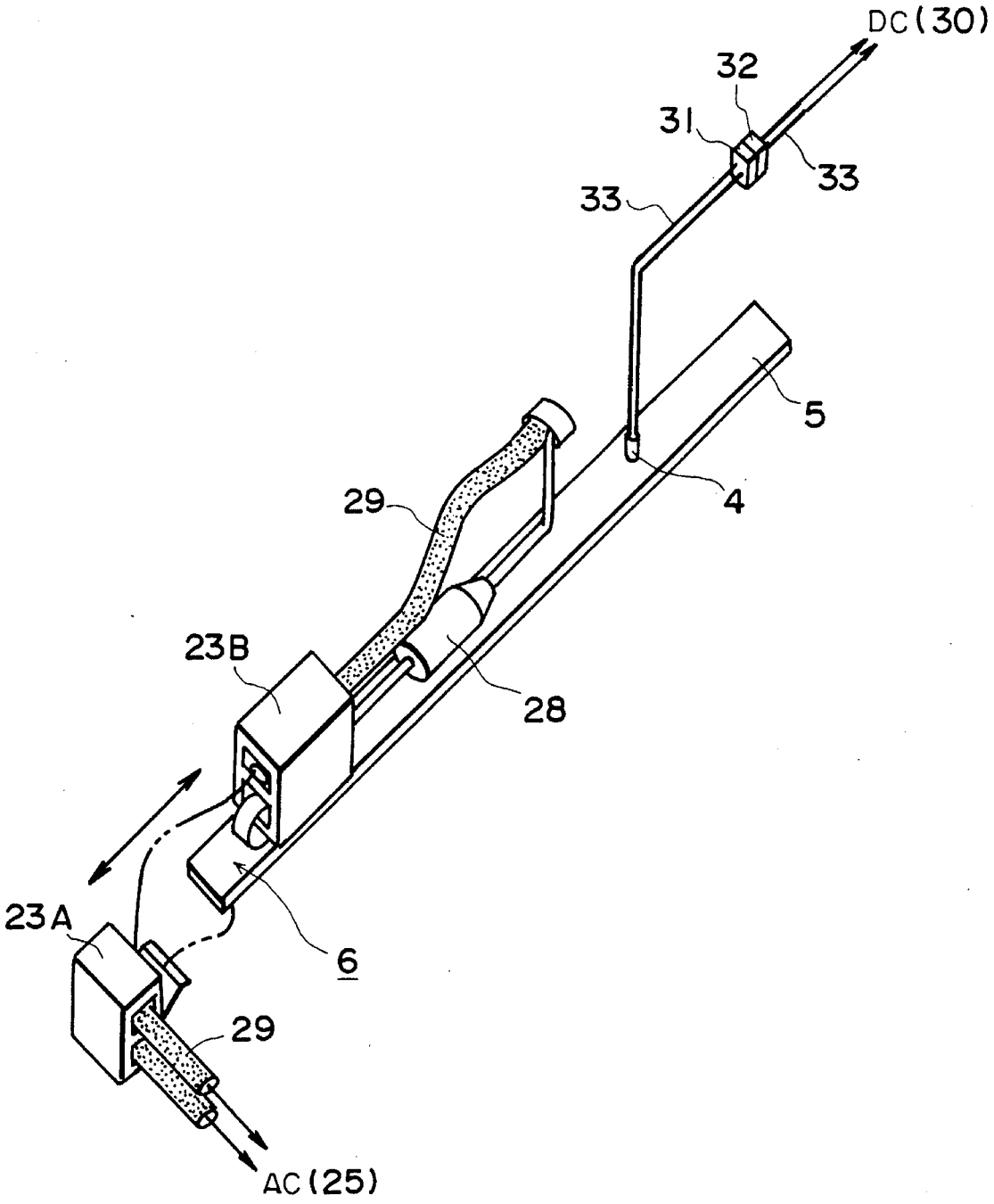
FIG. 3 is a perspective view of a heater according to another embodiment of the present invention.

Referring to FIG. 3, a heater according to another embodiment of the present invention will be described. In the apparatus of this embodiment, the contacts of the safety device 28 are connected to an AC connector 23B disposed at a left part of the backside of the heater.

The AC connector 23B is engaged with a demountable AC connector 23A, and is electrically connected with an AC voltage source 25 through an AC lead 29. The thermister 4 is electrically connected with a DC voltage source 30 through DC connectors 31 and 32 by DC lead 33.

Similarly to the foregoing embodiment, the thermister 4 may be mounted to the bottom side of the heater. In this embodiment, the AC connectors 23A and 23B, and DC connectors 31 and 32, are separately disposed to the opposite ends of the heater 6, similarly to the first embodiment. Therefore, the same advantageous effects as with the first embodiments, can be provided.

In this embodiment, the following peculiar advantageous effects are provided by engagement of the contacts of the safety device 28 by a single connector 23B. Since the contacts of the safety device 28 are engaged with the AC connector 23B so as to form a single unit, and therefore, the assembling operation and an exchanging operation of the safety device 28 is very easy.

In addition, the operation and continuity test of the safety device 28 are possible without heater. More particularly, the inspection of the parts can be carried out before assembling the heating apparatus. Therefore, the reassembling due to improper single part, can be made easier, and also, the number of parts to be thrown away, can be significantly reduced.

While the invention has been described with reference to the structures disclosed herein, it is not confined to the details set forth and this application is intended to cover such modifications or changes as may come within the purposes of the improvements or the scope of the following claims.

What is claimed is:

1. A heater comprising:

a base member having first and second longitudinal ends;

a resistor extended along a length of said base member, said resistor generating heat upon electric power supply thereto;

temperature detecting element for detecting a temperature of said base member;

first electric power supply contacts for supplying electric power to said resistor, said first contacts being provided only adjacent the first longitudinal end of said base member;

second electric power supply contacts for supplying electric power to said temperature detecting element, said second contacts being provided only adjacent the second longitudinal end of said base member.

2. A heater according to claim 1, wherein said base member has a high thermal conductivity.

3. A heater according to claim 1, wherein said resistor is supplied with the electric power having a predetermined frequency.

4. A heater according to claim 3, wherein said resistor is supplied with an AC electric power.

5. A heater according to claim 3, wherein said temperature detecting element is supplied with a DC power.

6. A heater according to claim 1, wherein said first contacts are provided on one side of said base member, and said second contacts are provided on one side of said base member.

7. A heater according to claim 1, wherein said heater is used for an image fixing apparatus for heat-fixing an image on a recording material, and wherein said fixing apparatus comprises electric power supply control means for controlling electric power supply to said resistor in accordance with an output of said temperature detecting element.

8. A heater according to claim 7, wherein said power supply control means controls the electric power supply such that said temperature detecting elements produces a predetermined target output.

9. A heater according to claim 7, wherein said fixing apparatus further comprises a film in sliding contact with said heater, and a back-up member for forming a nip with said heater with said film therebetween.

10. An image fixing apparatus, comprising:

a heater;

a film in slidable contact with said heater;

a back-up member cooperative with said heater to form a nip therebetween with said film therebetween;

wherein a recording material is nipped and moved by said nip so that an image is fixed on the recording material;

said heater including a base member having first and second longitudinal ends; a resistor extended along a length of said base member, said resistor generating heat upon electric power supply thereto; temperature detecting element for detecting a temperature of said base member; first electric power supply contacts for supplying electric power to said resistor, said first contacts being provided only adjacent said first longitudinal end of said base member; second electric power supply contacts for supplying electric power to said temperature detecting element, said second contacts being provided only adjacent said second longitudinal end of said base member.

11. An apparatus according to claim 10, further comprising control means for controlling electric power supply to said resistor on the basis of an output of said temperature detecting means.

12. An apparatus according to claim 11, wherein said electric power supply control means controls the electric power supply so that an output of said temperature detecting element is a predetermined level.

* * * * *